US006520146B2

(12) United States Patent
Laimböck

(10) Patent No.: US 6,520,146 B2
(45) Date of Patent: Feb. 18, 2003

(54) FOUR-STROKE INTERNAL COMBUSTION ENGINE WITH AT LEAST TWO INLET VALVES

(75) Inventor: Franz Laimböck, Thal (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 09/802,898

(22) Filed: Mar. 12, 2001

(65) Prior Publication Data

US 2001/0023680 A1 Sep. 27, 2001

(30) Foreign Application Priority Data

Mar. 14, 2000 (AT) ..... 181/00 U

(51) Int. Cl.[7] ..... F02B 31/06; F02B 31/08

(52) U.S. Cl. ..... 123/308; 123/184.45; 123/184.55; 123/184.59; 123/432

(58) Field of Search ..... 123/184.37, 184.45, 123/184.52, 184.55, 184.59, 308, 432

(56) References Cited

U.S. PATENT DOCUMENTS

| | | | | |
|---|---|---|---|---|
| 1,347,598 A | * | 7/1920 | Sturm | 123/184.45 |
| 1,422,810 A | * | 7/1922 | Appel | 123/184.45 X |
| 4,317,438 A | * | 3/1982 | Yagi et al. | 123/308 X |
| 4,380,516 A | | 4/1983 | Matsuzaka | 261/23.2 |
| 4,494,493 A | * | 1/1985 | Morikawa et al. | 123/308 X |
| 4,497,288 A | | 2/1985 | Nakano et al. | 123/184.52 |
| 4,520,775 A | * | 6/1985 | Nakamura | 123/308 |
| 4,550,700 A | * | 11/1985 | Yoshida et al. | 123/432 |
| 5,813,373 A | * | 9/1998 | Schlossarczyk et al. | 123/65 P |
| 5,823,160 A | * | 10/1998 | Oda et al. | 123/184.55 X |
| 6,216,666 B1 | * | 4/2001 | Handl et al. | 123/308 |

FOREIGN PATENT DOCUMENTS

| | | |
|---|---|---|
| AT | 402535 | 6/1997 |
| DE | 2854332 | 6/1979 |
| EP | 727572 | 8/1996 |

* cited by examiner

*Primary Examiner*—Tony M. Argenbright
(74) *Attorney, Agent, or Firm*—Dyhkema Gossett PLLC

(57) ABSTRACT

A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path is connected with a fuel supply device. In order to achieve in the simplest possible way an improvement of the exhaust gas quality at low fuel consumption, the fuel supply device is formed by a joint carburetor for both inlet ports, with preferably the carburetor being arranged in the zone of the branching of the inlet ports from the inlet pipe.

29 Claims, 4 Drawing Sheets

FOUR-STROKE INTERNAL COMBUSTION ENGINE WITH AT LEAST TWO INLET VALVES

BACKGROUND OF THE INVENTION

The invention relates to a four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device.

DESCRIPTION OF PRIOR ART

An internal combustion engine of the kind mentioned above is known from AT 402 535 B. In order to achieve a strong swirl of the charge in the combustion chamber under partial load without impairing the charge admission under full load due to adverser flow coefficients and thus impairing the engine's performance, the known internal combustion engine is provided with a charge loading port and a volumetric port. The fuel is injected via an injection apparatus into both inlet ports in the direction of the admission openings indirectly by means of an injection device arranged in the zone of the port separating wall between the two inlet ports. The mixture in the combustion chamber can be influenced by means of a throttle valve arranged in the volumetric port. Thus it is possible to produce in the combustion chamber a stratification in order to form an explosive, relatively rich mixture in the region of the spark plug with a generally lean mixture otherwise. This allows fulfilling particularly strict exhaust gas regulations at low fuel consumption.

Since the arrangement of the inlet port and the supply of fuel by means of indirect injection is relatively complex, the known system is particularly suitable for multi-track motor vehicles. Injection systems have not proven their worth in single-track motor vehicles, particularly where small-volume motorcycles are concerned, because the achieved fuel savings were far below expectations. Moreover, injection systems require a relatively large amount of control and energy, which has a negative effect on the size, weight and costs of the internal combustion engine.

SUMMARY OF THE INVENTION

It is the object of the present invention to avoid such disadvantages and to improve the exhaust gas quality in an internal combustion engine of the kind mentioned above in the simplest possible manner. At the same time it is the object to achieve the lowest possible fuel consumption.

This is achieved in accordance with the invention in that the fuel supply device is formed by a joint carburetor for both inlet ports, with preferably the carburetor being arranged in the zone of the branching of the inlet ports from the inlet pipe. As a result of the combination between load charging port, volumetric port and a fuel supply device arranged as a conventional carburetor, it is possible in a very simple manner to achieve a controlled combustion in the combustion chamber with very low emission values and very favorable fuel consumption. By using a conventional carburetor with a double inlet port configuration with a volumetric port and a charge loading port, it is possible to make do without any complex electric and electronic devices. Thus, one can omit complex control and regulation apparatuses for injecting the fuel, including the higher provision of energy. Carburetor technology moreover offers the highest possible reliability and the additional advantage that the dimensional volume, weight and costs of the internal combustion engine can be kept very low.

In order enable the optional performance of a stratification in the combustion chamber, it is provided for in a further embodiment of the invention that during the opening of the throttle device the charge loading port can be opened at first and the volumetric port thereafter.

The charge loading port has the task of providing the charge in the combustion chamber with a momentum about the cylinder axis. It can be arranged as a tangential or spiral port.

The carburetor can be formed by a slide valve carburetor, constant-pressure carburetor or a rotating throttle valve carburetor. In the case of a slide valve carburetor or a constant-pressure carburetor, the carburetor slide valve is arranged in the zone of the beginning of one port separating wall between the two inlet ports and forms a port separating member. The carburetor slide valve thus produces a port separation, so that the two inlet ports are released successively during a travel process of the slide valve. In this case the carburetor slide valve thus forms the throttle device. The throttle device can additionally be provided with throttle valve in one or both of the inlet ports.

If one throttle valve is arranged in each of the separate inlet ports, the throttle valves are preferably opened in a register-like manner one after the other.

If the carburetor is arranged as a rotating throttle valve carburetor, a throttle valve is provided for each inlet port. The two throttle valves open the two inlet ports one after the other in a register-like manner and thus form the throttle device.

In order to achieve a maximum output yield under full load, it is particularly advantageous that the carburetor is provided with a full-load power jet which is arranged in the direction of flow to the volumetric port, so that the fuel jet predominantly enters the volumetric port.

It is provided for in a further development of the invention that at least one self-opening diaphragm valve is provided in the port separating wall between the two inlet ports downstream of the throttle device, which diaphragm valve connects the two inlet ports and which preferably produces the flow connection from the charge loading port to the volumetric port in the case of pressure difference. This allows an improvement in the charging of the cylinder.

It is very advantageous for improving the exhaust gas quality when at least one exhaust gas return conduit opens into at least one inlet port, preferably into the charge loading port. It can be provided for in this respect that the exhaust gas return can be actuated by a slide valve which is preferably coupled with the control for the throttle device.

It can be provided for on the basis of the concept that the charge loading port which is arranged as a tangential or swirl port is provided with a larger length than the volumetric port. If the charge loading port is arranged as a tangential port, it is provided with only a low curvature and is strongly inclined towards the valve axis and produces a flow which hits the cylinder wall tangentially and leads to the formation of a strong swirling movement in the cylinder. The volumetric or neutral port is provided with a stronger curvature as compared with the tangential port, but shows a lower inclination towards the valve axis. It produces a stream directed approximately against the centre of the cylinder which neither produces a marked swirling movement, nor a tumble movement.

The throttling of the volumetric port ensures that the admission of the charge from this port occurs with a lower impulse into the cylinder chamber than the air supplied by the tangential port. The overall flow field in the cylinder chamber is thus dominated by the unthrottled tangential port. The charge loading thus produces a rapid, stable and even combustion. This leads to a lower susceptibility to engine knock despite higher compression. This creates the prerequisites for achieving high thinnability in order to achieve lower fuel consumption. At the same time, compatibility for higher exhaust gas return rates is increased, thus enabling a considerable decrease in NOx emissions.

In order to produce the described charge movement in the combustion chamber it is advantageous when at least two inlet ports are arranged above one another in the zone of the carburetor, with the volumetric port preferably being arranged above the charge loading port.

In order to provide the internal combustion engine as compact as possible, the carburetor is arranged as a cross flow carburetor. Notice should be taken that the inlet ports are provided between the carburetor and the inlet valves with a horizontal guidance, preferably a slope.

It can further be provided within the scope of the invention that at least one inlet port, preferably the charge loading port, is provided with at least one stall edge. This helps prevent that a fuel wall film produced by the fuel introduction is directed onto the cylinder wall. It is particularly advantageous when the stall edge is arranged on a side of the inlet port which is adjacent to the wall of the cylinder. As the fuel wall films occur cumulatively at the outer side of the port curvatures, it is preferably provided that the stall edge is arranged on the outer side of an arc-shaped section of the inlet port.

In order to enable utilising resonance effects of the inlet ports for charging the cylinder in the partial load range in particular, it is advantageous when a port loop is arranged in one of the inlet ports. The port loop is preferably arranged in the charge loading port and is provided with a loop-like shape. In order to enable the charge to be supplied over the shortest possible path to the cylinder, the port loop can be by-passed via a by-pass opening in the zone of the port loop crossing, with the by-pass opening being controlled by a by-pass valve depending on the engine load. The by-pass valve is designed in a particularly simple arrangement as a membrane valve which opens and closes the by-pass valve depending on the pressure difference between the loop entrance and the loop exit.

BRIEF DESCRIPTION OF THE DRAWINGS

The invention is now explained in closer detail below by reference to the enclosed drawings, wherein.

DETAILED DESCRIPTION OF THE PREFERRED EMBODIMENTS

Figure 1:
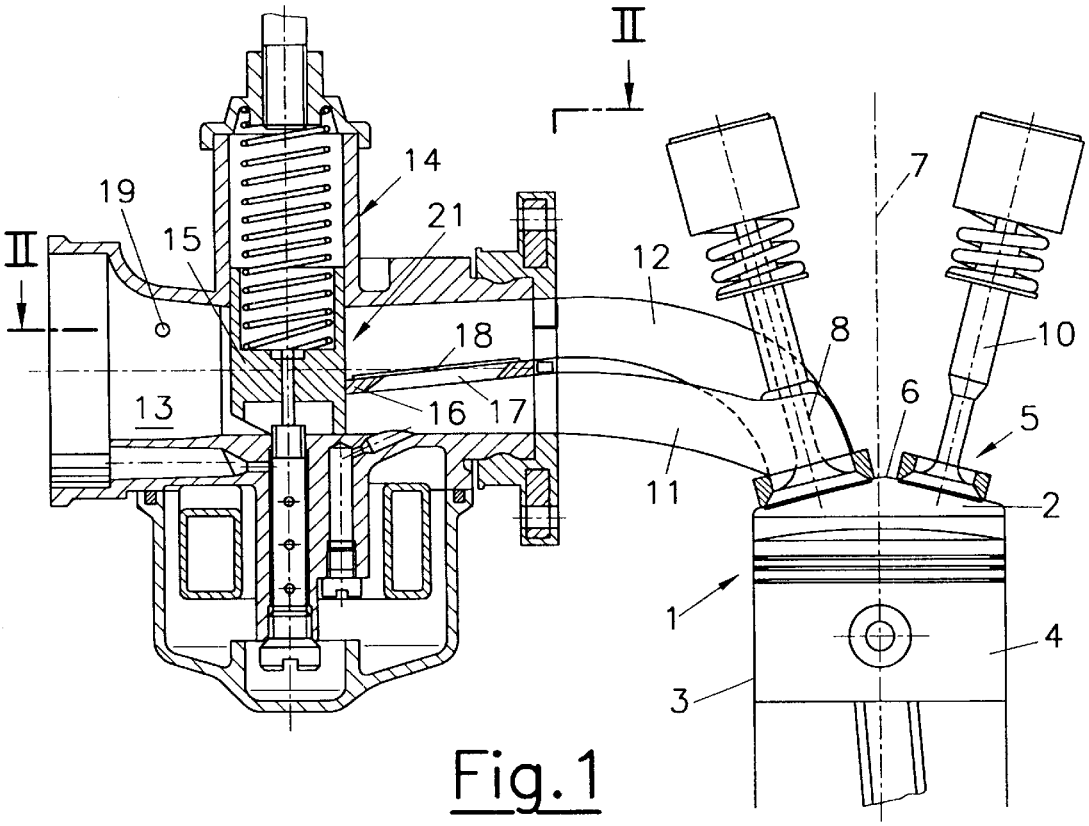
FIG. 1 schematically shows the internal combustion engine in an embodiment in a cross sectional view.

FIG. 1 shows a cross sectional view of an internal combustion engine 1 in accordance with the invention which is normal to the crankshaft axis 7*a*. The combustion chamber 2 is formed by a piston 4 reciprocating in a cylinder 3 and by the roof-like combustion chamber cover 6 which is formed by the cylinder head 5. A first and second inlet port which are guided separately up to the inlet valves 8 and 9 open into the combustion chamber 2, which inlet valves 8 and 9 are arranged inclined to the cylinder axis 7. The first inlet port is arranged as a charge loading port 11 and the second inlet port as a volumetric port 12. The charge loading port 11 can be a tangential or spiral port. The outlet valves are designated with the reference numeral 10.

Figure 2:
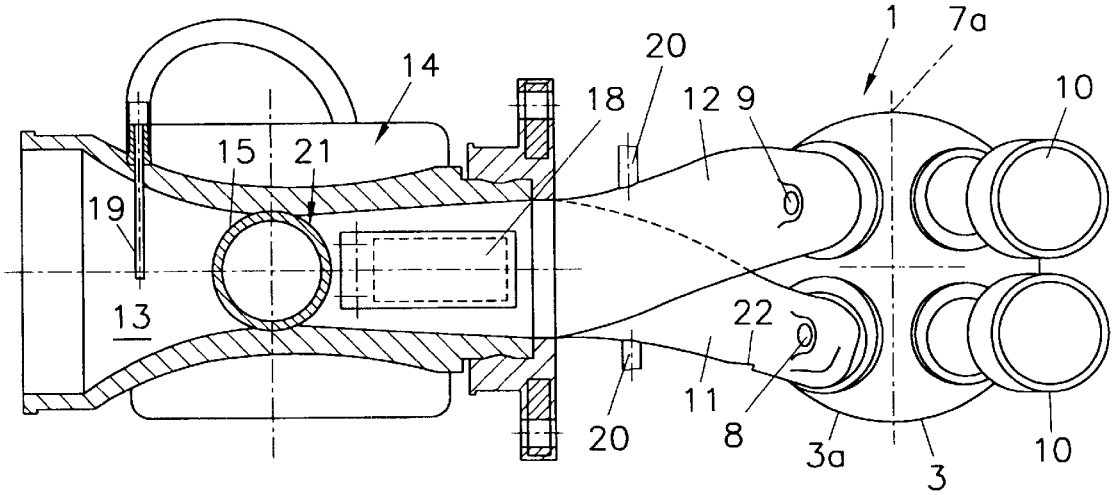
FIG. 2 schematically shows the internal combustion engine in a sectional view according to line II—II in FIG. 1.

The charge loading port 11 and the volumetric port 12 branch off a common inlet pipe 13 in which a carburetor 14 is arranged as a fuel supply device. In the embodiment shown in FIGS. 1 and 2 the carburetor 14 is arranged as a slide valve carburetor and is provided with a cylindrical carburetor slide valve 15 for example. The carburetor slide valve 15 is arranged in the zone at the beginning of the port separating wall 16 between the charge loading port 11 and the volumetric port 12 and acts as a throttle device 21 and as a port separating device for the two inlet ports.

The port separating wall 16 between the charge loading port 11 and the volumetric port 12 is provided in its initial zone with an opening 17 which is closed off by a diaphragm valve 18. In the case of any pressure difference between the charge loading port 11 and the volumetric port 12, the diaphragm valve 18 opens, so that a flow connection from the charge loading port 11 to the volumetric port 12 is produced.

Upstream of the carburettor slide valve 15 a full-load power jet 19 opens into the inlet pipe 13 and is attached in the upper half of the inlet pipe 13 in such a way that an emerging fuel jet will predominantly enter the volumetric port 12.

The throttle device 21 formed by the carburetor slide valve 15 is used for charge control. During the opening movement, the carburetor slide valve 15 first opens the charge loading port 11 and then the volumetric port 12.

An exhaust gas return conduit 20 opens at least into the charge loading port 11. A stall edge disposed in the charge loading port 11 is designated with reference numeral 22 which will remove any occurring fuel wall film from the port wall and will prevent any wetting of wall 3*a* of the cylinder 3.

Figure 3:
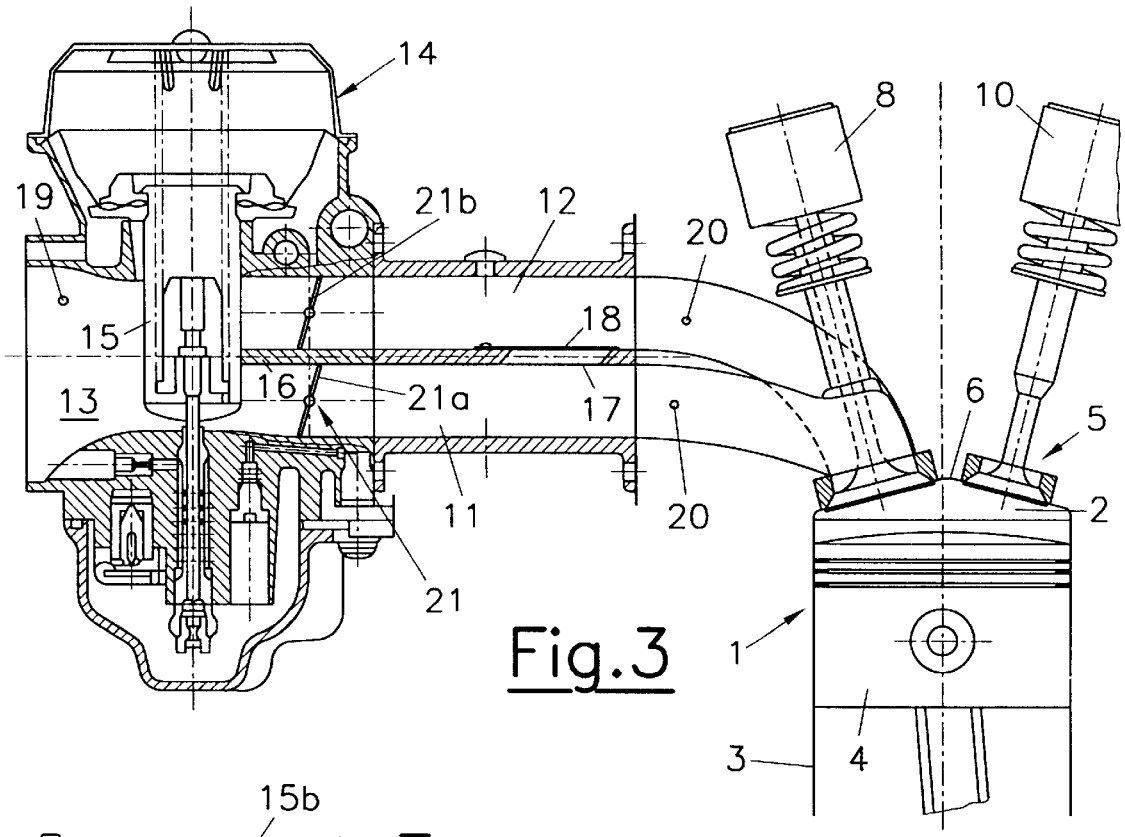
FIG. 3 schematically shows an internal combustion engine in accordance with the invention in a second embodiment.

FIG. 3 shows an embodiment of an internal combustion engine in which a carburetor 14 arranged as a constant-pressure carburetor is provided in the initial region of the charge loading port 11 and the volumetric port 12. Carburetor 14 is provided with a carburetor slide valve 15 in the zone of the beginning of the port separating wall 16. Throttle valves 21*a* and 21*b*, which act as throttle devices, are provided in the charge loading port 11 as well as the volumetric port 12. The throttle valves 21*a* and 21*b* can be opened successively in a register-like manner, so that the charge loading port 11 is opened first and thereafter the volumetric port 12. An exhaust gas return conduit 20 opens into at least one of the two inlet ports. Exhaust gas return can be controlled through a slide valve (not shown in closer detail) which is coupled with the control unit for throttle valves 21*a* and 21*b* via an actuating distributor. Exhaust gas return is thus possible in certain positions of the throttle valves 21*a* and 21*b*.

An opening 17 is also provided in this embodiment in the port separating wall 16 between the charge loading port 11 and the volumetric port 12, which opening is closed off by a diaphragm valve 18 and is only opened in the case of sufficient pressure difference between the two ports.

Figure 4:
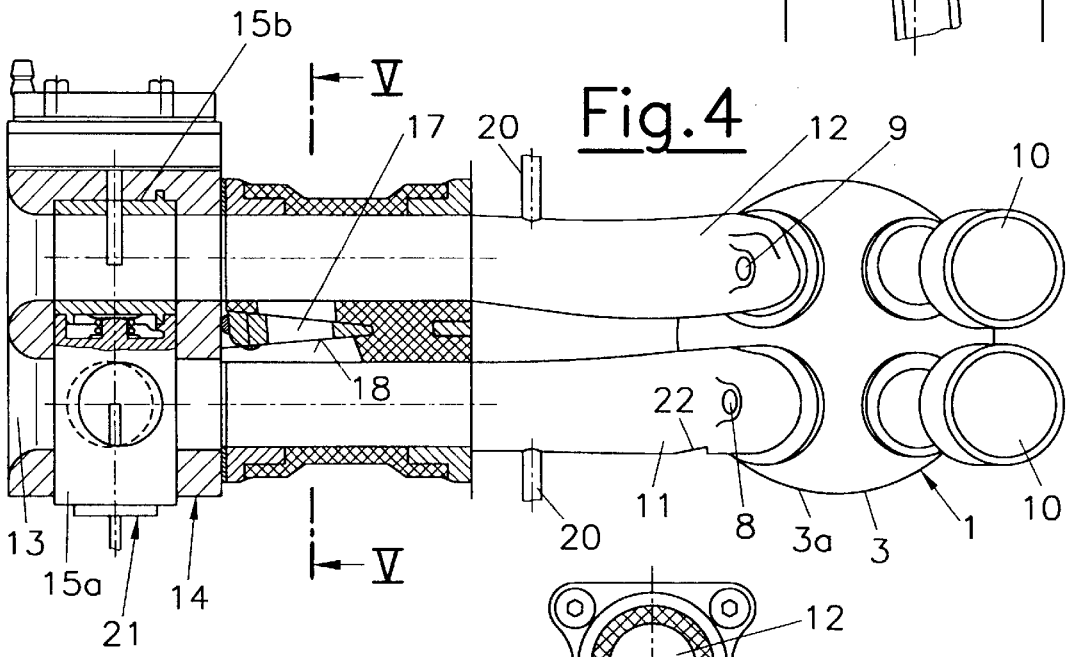
FIG. 4 schematically shows an internal combustion engine in accordance with the invention in a third embodiment.
Figure 5:
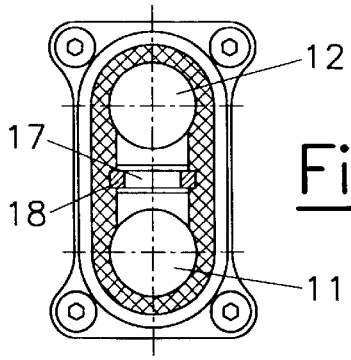
FIG. 5 shows a sectional view through the inlet ports according to line V—V in FIG. 4.

FIGS. 4 and 5 show a further embodiment in analogy to the described examples, with carburetor 14 being formed by a rotating throttle valve carburetor. Carburetor 14 is provided for each inlet port with a rotating throttle valve 15*a*, 15*b*, which means one for the charge loading port 11 and one for the volumetric port 12. The rotating throttle valves 15*a*, 15*b* which form the throttle device 21 can be opened successively in a register-like manner, so that first the charge loading port 11 and thereafter the volumetric port 12 is opened. Downstream of the carburetor 14 the separating wall 16 is provided with an opening 17 between the charge loading port 11 and the volumetric port 12 in analogy to the aforementioned embodiments, which opening can be closed by a diaphragm valve 18. A flow connection can be produced between the charge loading port 11 and the volumetric port 12 in the case of a pressure difference.

Figure 6:
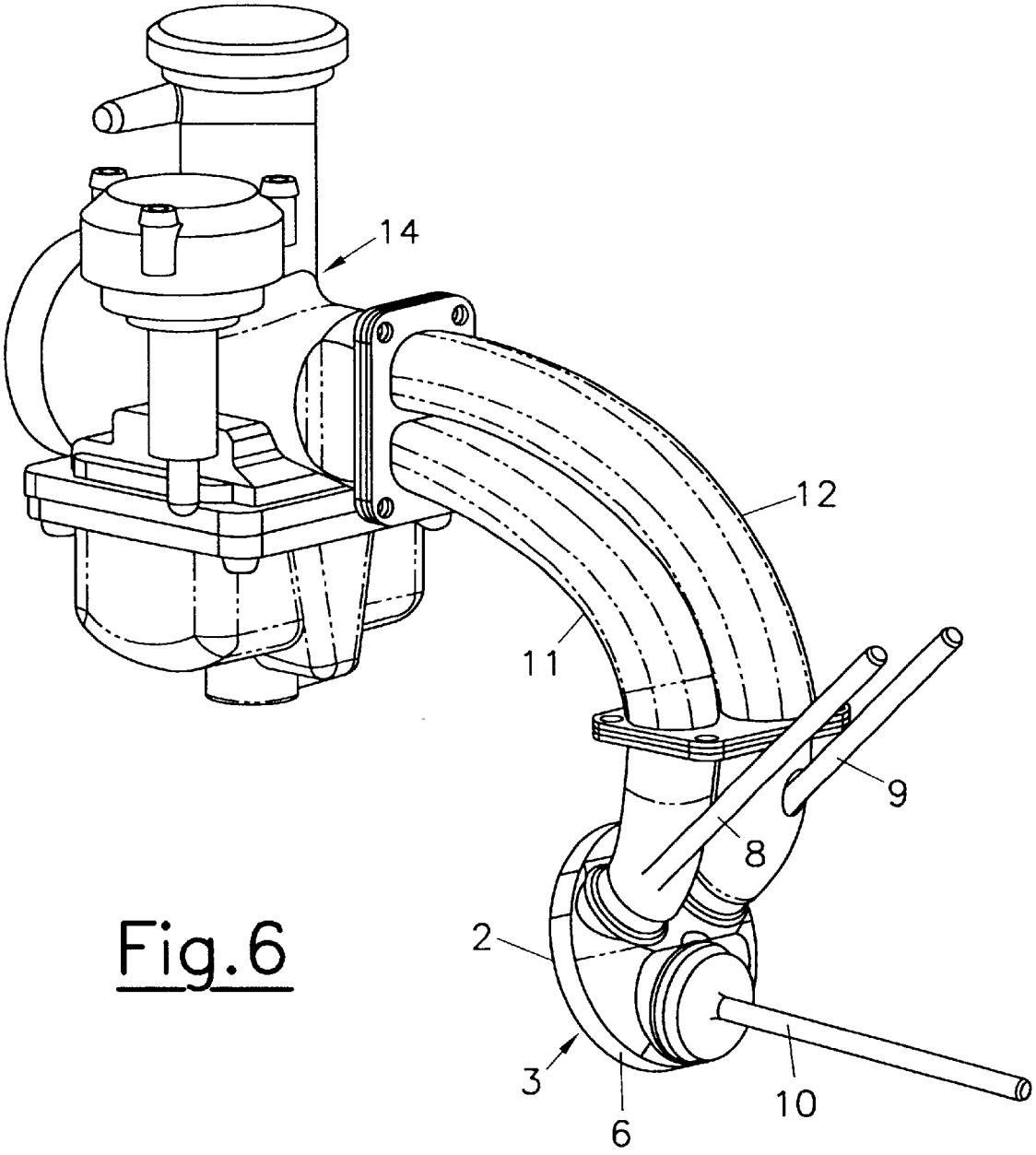
FIG. 6 shows an oblique view of an internal combustion engine in accordance with the invention.

FIG. 6 shows an oblique view of an internal combustion engine with a carburetor 14 and a cylinder 3 indicated by a combustion chamber cover 6. Carburetor 14 is arranged as a constant-pressure carburetor for example. A bent charge loading port 11 and a bent volumetric port 12 start out from carburetor 14 and open into combustion chamber 2 by way of inlet valves 8, 9 which are arranged in the combustion chamber cover 6. Only one outlet valve 10 is provided for each cylinder 3 in the example shown in FIG. 6.

Figure 7:
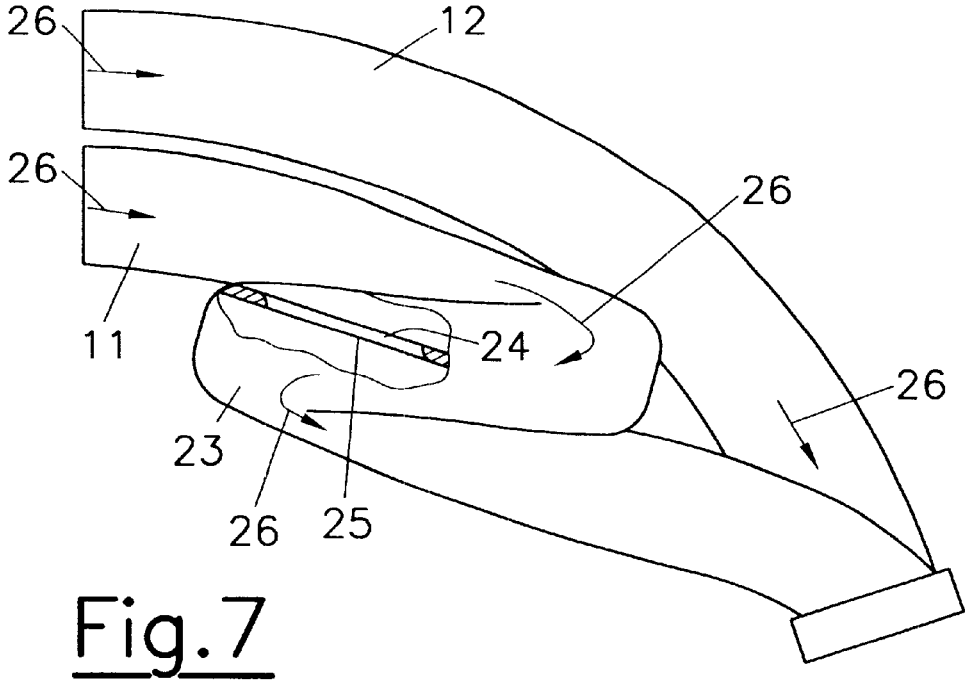
FIG. 7 and FIG. 8 show side views and top views of inlet ports of an internal combustion engine in a further embodiment.
Figure 8:
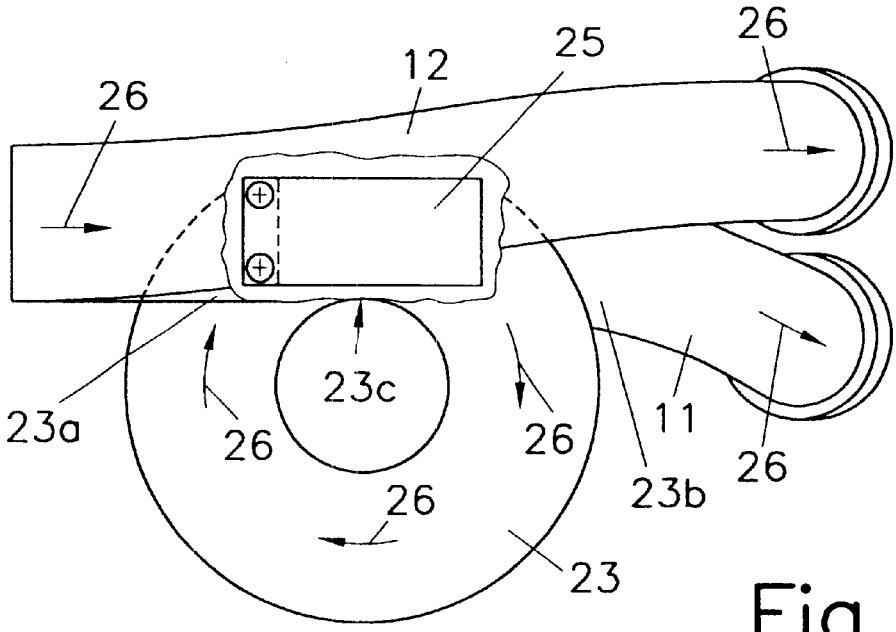

FIGS. 7 and 8 show a charge loading port 11 and a volumetric port 12 of a further embodiment of an internal combustion engine. The charge loading port 11 is provided with a port 23 in which the charge is deflected over an angular range of approx. 360°. This extends the suction path in order to utilise resonance effects for the cylinder charging in the partial-load range. The annular port loop 23 can be by-passed by way of a by-pass opening 24 in the wall 11*a* of the charge loading port 11, which by-pass opening is arranged in the zone of the loop crossing 23*c*. The flow through the by-passing opening 24 can be controlled by a by-pass valve 25 depending on the engine load. The by-pass valve 25 is arranged in FIGS. 7 and 8 as a diaphragm valve which opens at a predefined pressure difference between loop entrance 23*a* and loop exit 23*b*. Accordingly, the port loop 23 can be by-passed under full load in order to avoid volumetric losses as a result of the extended flow path. The flow through the inlet ports is indicated with the arrows 26.

What is claimed is:

1. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device, wherein the fuel supply device is formed by a joint carburetor for both inlet ports, wherein the carburetor is a constant-pressure carburetor which is provided with a carburetor slide valve which is arranged in the zone of the beginning of one port separating wall between the two inlet ports and forms a port separating member.

2. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device, wherein the fuel supply device is formed by a joint carburetor for both inlet ports, wherein the carburetor is provided with a full-load power jet which is arranged in the direction of flow to the volumetric port, so that the fuel jet of the full-load power jet predominantly enters the volumetric port.

3. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device, wherein the fuel supply device is formed by a joint carburetor for both inlet ports, wherein at least one self-opening diaphragm valve is provided in the port separating wall between the two inlet ports downstream of the throttle device, which diaphragm valve connects the two inlet ports and which produces the flow connection from the charge loading port to the volumetric port in the case of pressure difference.

4. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device, wherein the fuel supply device is formed by a joint carburetor for both inlet ports, wherein downstream of the throttle device at least one exhaust gas return conduit opens into at least one inlet port and wherein the exhaust gas return conduit opens into at least one inlet port and wherein the exhaust gas return can be actuated by a slide valve which is coupled with the control for the throttle device.

5. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port is volumetric port, with a throttle device for volumetric control being provided in the inlet flow path and the inlet flow path being connected with a fuel supply device, wherein the fuel supply device is formed by a joint carburetor for both inlet ports, wherein the length of the charge loading port and the volumetric port is different, with the charge loading port being longer than the volumetric port.

6. A four-stroke internal combustion engine with at lest two inlet valves and an inlet flow path with at lest two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path being connected with a fuel supply device, wherein the fuel supply device is formed by a joint carburetor for both inlet ports, wherein at least two inlet ports are arranged above one another in the zone of the carburetor outlet and wherein the volumetric port is arranged above the charge loading port.

7. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device, wherein the fuel supply device is formed by a joint carburetor for both inlet ports, wherein at least one inlet port is provided with at least one stall edge.

8. A four-stroke internal combustion engine with at least two inlet valves and an inlet flow path with at least two inlet ports per cylinder which branch off from a common inlet pipe and are guided separately up to the inlet valves and of which at least one inlet port is designed as a charge loading port and at least one inlet port as a volumetric port, with a throttle device for volumetric control being provided in the inlet flow path and the inlet flow path being connected with a fuel supply device, wherein the fuel supply device is formed by a joint carburetor for both inlet ports, wherein a port loop is arranged in one of the inlet ports.

9. An internal combustion engine according to claims 1, 2, 3, 4, 5, 6 or 7, wherein the carburetor is arranged in the zone of the branching of the inlet ports from the inlet pipe.

10. An internal combustion engine according to claims 1, 2, 3, 4, 5, 6 or 7, wherein first the charge loading port and thereafter the volumetric port can be opened during the opening of the throttle device.

11. An internal combustion engine according to claims 1, 2, 3, 4, 5, 6 or 7, wherein the charge loading port is arranged as a tangential port.

12. An internal combustion engine according to claims 1, 2, 3, 4, 5, 6 or 7, wherein the loading port is arranged as a spiral port.

13. An internal combustion engine according to claims 1, 2, 3, 4, 5, 6 or 7, wherein the carburetor is a slide valve carburetor.

14. An internal combustion engine according to claim 13, wherein the carburettor is provided with a carburettor slide valve which is arranged in the zone of the beginning of one port separating wall between the two inlet ports and forms of a port separating member.

15. An internal combustion engine according to claim 14, wherein the carburettor slide valve forms a throttle device.

16. An internal combustion engine according to claim 1, wherein the carburetor slide valve forms a throttle device.

17. An internal combustion engine according to claims 1, 2, 3, 4, 5, 6, 7 or 8, wherein the carburetor is arranged as a rotating throttle valve carburetor.

18. An internal combustion engine according to claim 17, wherein a rotating throttle valve is arranged in each of the inlet ports and wherein the rotating throttle valves are successively actuatable in a register manner.

19. An internal combustion engine according to claim 18, wherein the rotating throttle valves form the throttle device.

20. An internal combustion engine according to claims 1, 2, 3, 4, 5, 6, 7 or 8, wherein the throttle device is provided with at least one throttle valve per inlet port.

21. An internal combustion engine according to claims 1, 2, 3, 4, 5, 6, 7 or 8, wherein the inlet ports are provided with a slope between carburetor and inlet valve.

22. An internal combustion engine according to claims 1, 2, 3, 4, 5, 6, 7 or 8, wherein the carburetor is arranged as a cross flow carburetor.

23. An internal combustion engine according to claim 7, wherein the charge loading port is provided with at least one stall edge.

24. An internal combustion engine according to claim 7, wherein the stall edge is arranged on a side of the inlet port which is adjacent to the wall of the cylinder.

25. An internal combustion engine according to claim 7, wherein the stall edge is arranged on the outside of an arc-shaped section of the inlet port.

26. An internal combustion engine according to claim 8, wherein the port loop is arranged in the charge loading port.

27. An internal combustion engine according to claim 8, wherein the port loop can be by-passed depending on the operating status of the engine.

28. An internal combustion engine according to claim 27, wherein the port loop can by by-passed by a by-pass valve which controls a by-pass opening.

29. An internal combustion engine according to claim 28, wherein the by-pass valve is a diaphragm valve which opens the by-pass opening at a predefined pressure difference between the loop entrance and the loop exit of the port loop.

* * * * *